United States Patent [19]

Fogel

[11] 4,204,289

[45] May 27, 1980

[54] WATERBED MATTRESS

[75] Inventor: Isaac Fogel, Silver Spring, Md.

[73] Assignee: Classic Corporation, Jessup, Md.

[21] Appl. No.: 896,300

[22] Filed: Apr. 14, 1978

[51] Int. Cl.[2] ..... A47C 27/08

[52] U.S. Cl. ..... 5/451; 5/458

[58] Field of Search ..... 5/365, 349, 350, 370, 5/371, 451, 452, 457, 458

[56] References Cited

U.S. PATENT DOCUMENTS

| | | | |
|---|---|---|---|
| 3,030,640 | 4/1962 | Gosman | 5/349 |
| 3,736,604 | 6/1973 | Carson | 5/366 |
| 3,840,921 | 10/1974 | Labianco | 5/371 |
| 4,079,473 | 3/1978 | Phillips | 5/371 |

*Primary Examiner*—Alexander Grosz

*Attorney, Agent, or Firm*—Leitner, Palan, Lyman, Martin & Bernstein

[57] ABSTRACT

A waterbed mattress construction includes a plurality of water wave action damper baffles which extend vertically between the bottom and top interior surfaces of the mattress. The damper baffles comprise a plurality of flexible plastic housings welded to the interior bottom surface of the mattress, and floatation rings or discs bonded to the interior of the housing. The damper baffles are positioned in rows within the mattress to interfere with and destroy any water wave action.

7 Claims, 4 Drawing Figures

WATERBED MATTRESS

BACKGROUND OF THE INVENTION

The present invention relates to a waterbed mattress and, more particularly, to a waterbed mattress which has internal vertical baffles for reducing water wave action within the mattress.

Although waterbeds of various constructions have become extremely popular in recent years, many individuals have purchased waterbeds and have been dissatisfied with them. The water mattress, which is basically a non-form retaining bag filled to capacity with water, exhibits a resonant frequency phenomenon related to the size of the bag and the mass of the water. Many individuals find this resonant characteristic disruptive of sleep or other pursuits.

A waterbed mattress is supported on four sides. With the advent of waterbeds, a special frame structure was developed to support a water-filled mattress. Generally, the most commonly used structure includes a platform or pedestal which raises the height of the mattress to the level of a conventional bed. The pedestal may be of any structural design. Usually, commercial pedestals are somewhat smaller in dimensions than the mattress and the supporting frame. The waterbed frame, therefore, may extend beyond the pedestal as much as a foot on all four sides. The waterbed frame includes a decking board, which rests on the pedestal, and an upstanding frame structure that includes rails. A waterbed mattress is supported on the decking board and within the upstanding frame. The pedestal and frame combination provides a basic unit which can be used for contemporary or traditional decor.

The most widely accepted mattress size is the queen size which measures 60×80 inches. A queen size waterbed mattress which is 9 inches deep will hold approximately 187 gallons of water. A person lying on a waterbed mattress which holds that much water will create a transverse wave action each time he shifts his body weight. Once the water is set into motion, a resonant frequency develops which strikes the sides of the supporting frame of the bed and returns in the opposite direction. Any continuous movement will cause a larger resonant frequency which would require several minutes to dissipate.

In prior waterbed mattresses, there have been attempts to alleviate the problem of resonant frequencies created from water wave action. One of the most common solutions is to reduce the thickness or height of the waterbed mattress and cushioning it with foam pads. Tinnel, U.S. Pat. No. 4,015,299, is directed to such a waterbed construction. Even though the Tinnel construction is intended to reduce resonant frequencies, it is highly likely that there will be a substantial amount of resonant frequency. Furthermore, the Tinnel construction requires the use of a substantial amount of foam padding which increases the cost of the mattress.

Labianco, U.S. Pat. No. 3,840,921, provides a waterbed mattress construction with a pair of parallel internal baffles which are joined with the interior top and bottom surfaces of the mattress. Each baffle extends for a major portion of the length of the mattress, and thereby forms separate parallel chambers within the mattress. The ends of the chambers are in intercommunication adjacent to the ends of the mattress. This baffle arrangement allows water in the mattress to swirl from one chamber to the next. While the use of baffles is superior to other solutions for reducing water wave action and the inherent resonant frequency associated therewith, the fact remains that baffles arranged parallel to each other with intercommunication at each end of the mattress will not arrest the wave action in a short period of time. The swirling water at each end of the mattress does not dampen the wave action. In fact, the transverse wave action in combination with the swirling water creates stresses on the baffles where they are joined to the interior top and bottom surfaces. Quite often these stresses result in pulling the baffles loose from the mattress, thereby destroying the dampening effect. The Labianco baffle arrangement is intended to be used with a waterbed frame having inclined walls such that some of the wave action bulges the mattress over the end of the frame to take up some of the resonant frequency, which is entirely different from the present invention which uses a regular waterbed frame without inclined walls.

Carson et al, U.S. Pat. No. 3,736,604, disclose a waterbed mattress which includes baffles suspended from the interior top surface. The baffles are bottom weighted to resist the water wave action. The baffles also have holes to provide a restricted communication between the chambers formed by the baffles. The baffles run lengthwise and crosswise, with the crosswise baffles spaced between the lengthwise baffles. The Carson et al baffle arrangement sets up relatively stationary walls across the mattress since the crosswise baffles interfere with any movement of the lengthwise baffles.

SUMMARY OF THE INVENTION

It is an object of the present invention to provide a waterbed mattress which overcomes objectionable water wave action commonly associated with waterbeds.

It is a further object of the present invention to provide a waterbed mattress with a baffle dampener arrangement which reduces the resonant frequency of a wave by one-third or better.

It is still another object of this invention to provide a waterbed mattress which can be used with a waterbed frame having upright rails and still dampen any water wave action.

According to the invention, there is provided a waterbed mattress which includes a top sheet and a bottom sheet with a plurality of damper baffles attached to the interior of the bottom sheet and extending vertically to contact the interior of the top sheet. The damper baffles include flexible plastic housings having floatation members bonded to the interior surface of each housing. The damper baffles are arranged in rows within the mattress to absorb and destroy any water wave action.

DESCRIPTION OF THE PREFERRED EMBODIMENT

Figure 1:
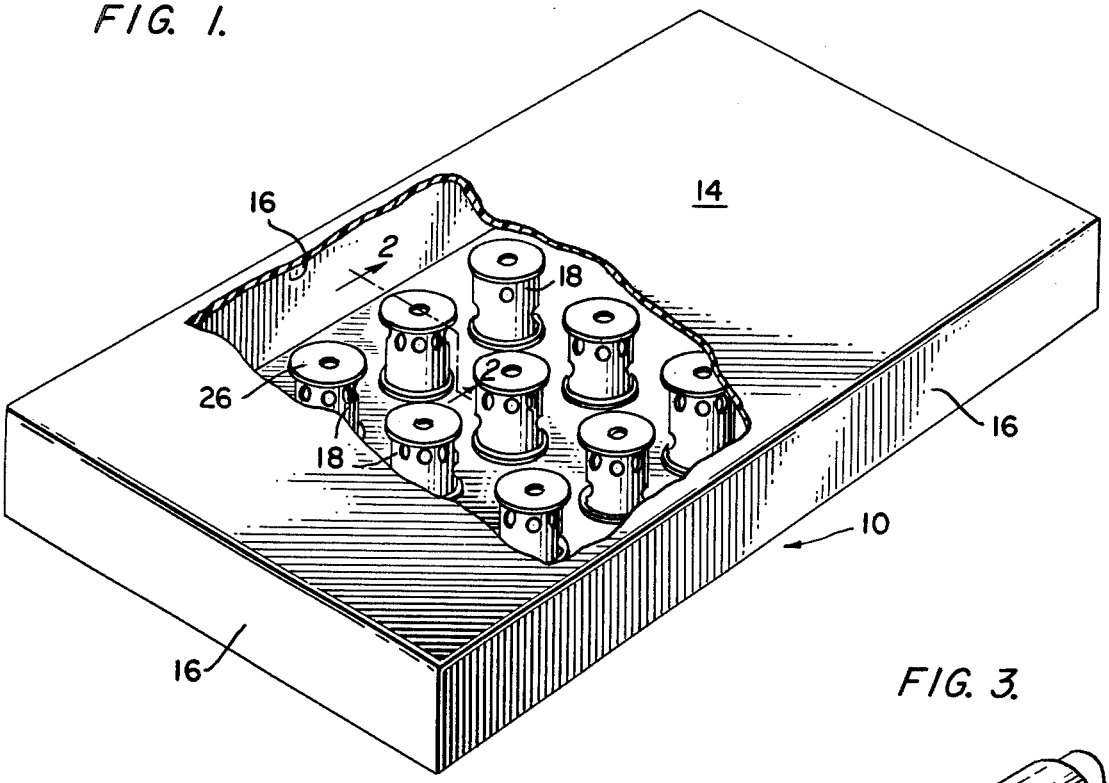
FIG. 1 is a perspective view of the waterbed mattress of this invention.

Referring to the drawings and, in particular, to FIG. 1, there is shown a waterbed mattress of the present invention which includes a sturdy rectangular waterbed mattress shell 10 of vinyl, polyethylene, or a similar impervious synthetic plastic. The waterbed mattress shell 10 is similar in length and width to the frame structure of a regular, full, queen or king size waterbed which includes a pedestal, a decking board, and upstanding peripheral rails. A typical waterbed frame is shown in my co-pending application entitled Waterbed Mattress, Ser. No. 890,993 now U.S. Pat. No. 4,152,796, and the waterbed frame discussed therein is incorporated in this discussion by reference. The completed waterbed frame with upstanding rails forms an open box-like structure with a cavity area for receiving and supporting the waterbed mattress of this invention.

The waterbed mattress shell 10 has a bottom wall 12, a top wall 14 and peripheral vertical walls 16. The mattress shell 10 is formed by double heat welding the top and bottom walls to the peripheral vertical walls.

The damper baffles 18 of the present invention are arranged in rows as shown in FIG. 1 with very little, if any, space between the rows. The rows are shown separated from each other to more clearly show each individual damper baffle. It is also possible to stagger the rows such that parallel rows have a non-parallel row spaced in between.

Figure 2:
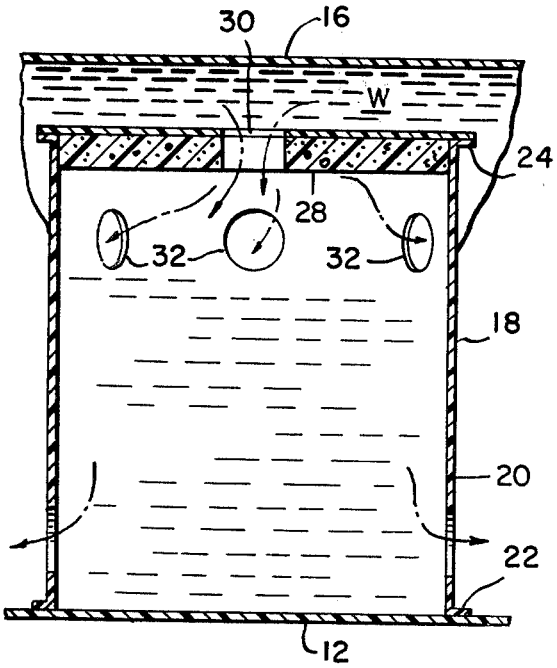
FIG. 2 is a sectional view of a damper baffle of this invention taken along the line 2—2 of FIG. 1.

The cylindrical damper baffle 18, FIG. 2, has a cylindrical vertical wall 20 of a flexible plastic material similar to the plastic material used to make the waterbed mattress shell 10. The cylindrical vertical wall 20 has a flange 22 which provides a surface for heat welding the damper baffle 18 to the interior surface of the bottom sheet 12, and a flange 24 which provides a surface for heat welding an end cap 26 to the cylindrical vertical wall 20 as shown in FIG. 1. The end cap 26 has a floatation ring or disc 28 bonded to the interior surface of the cap. The floatation ring 28 is a closed cell plastic foam of a synthetic plastic, such as a polyurethane foam. There is a central aperture 30 in the end cap 26 and a plurality of apertures 32 in the cylindrical vertical wall 20 of damper baffle 18. The size and number of these apertures can vary according to the depth of the waterbed mattress 10.

The assembled waterbed mattress shell 10, shown in FIG. 2, may have a slight space between the interior surface of top sheet 16 and the exterior surface of end cap 26. The weight of a person's body will force the top sheet 16 into rubbing contact with the end cap 26 thereby minimizing or eliminating the space.

During the course of a night's sleep a person may shift his body weight a number of times creating a transverse wave action within the waterbed mattress. If this wave action is not dampened, a resonant frequency will develop, disrupting a person's sleep. The rows of damper baffles 28 are arranged to interfere with the water wave action and possible resonant frequency. A water wave coming in contact with a damper baffle 18 strikes either the solid cylindrical vertical wall 18 or enters the baffle through one or more of the apertures 32. Where a wave strikes the solid wall 18 the damper baffle 18 is moved against the weight of the quiescent water contained within the cylindrical shape of the damper baffle. Should a wave or a portion of a wave enter the damper baffle 18, the quiescent water slowly exits through the apertures 32 in the other side of the cylindrical vertical wall 18 and through aperture 30 in the end cap 26. The slow movement of the dampener baffle 18 will absorb most or all of the water wave action. The wave absorption is further aided by the rubbing contact of the end cap 26 with interior surface of top wall 16. The vertical length of the cylindrical wall 20 is such that the end cap 26 of the damper baffle 18 is adjacent and, when a person is on the top sheet 16, generally contacts the interior surface of the top sheet 16 when supported by the floatation ring 28. Since the damper baffle 18 substantially fills the vertical distance between the interior top and bottom surfaces of the mattress shell 10, the baffle also interferes with any water waves which may occur near the interior surface of top wall 16 of the mattress.

Figure 3:
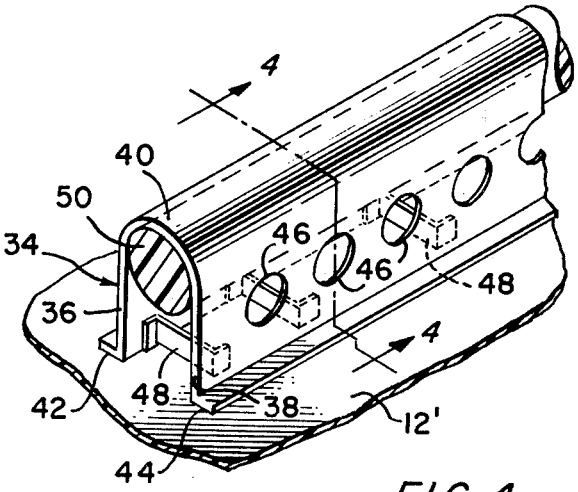
FIG. 3 is a perspective view of another embodiment of the damper baffle of the invention.
Figure 4:
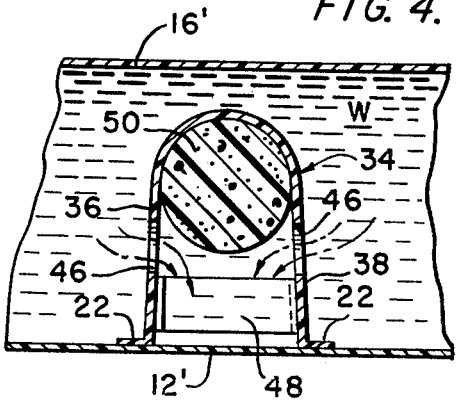
FIG. 4 is a sectional view of the damper baffle of FIG. 3 taken along line 3—3.

Another embodiment of the invention is shown in FIGS. 3 and 4 where a section of a waterbed mattress bottom wall 12 is shown with an inverted U-shaped damper baffle housing 34 heat welded to the interior of the bottom wall. The inverted U-shaped damper baffle housing 34 includes a pair of legs 36 and 38 and an integral continuous top wall 40. The lower ends of the legs 36 and 38 have flanges 42 and 44, respectively, for heat welding the damper baffle housing 34 to the interior surface of bottom wall 12. There are a plurality of apertures 46 in the legs 36 and 38 for allowing any water wave action to enter the damper baffle housing 34. Since there may be a large amount of force associated with the wave action a plurality of cross strips 48 are welded between the interior surfaces of legs 36 and 38 to prevent unnecessary strain on the damper baffle housing 34. An elongated floatation rod 50 is fixed to the interior surface of integral continuous top wall 40 to extend the damper baffle housing vertically between the bottom wall 12 and the top wall 16. A number of inverted U-shaped damper baffles 34 are arranged in rows (not shown) running either lengthwise, crosswise or diagonally within the waterbed mattress.

Having thus described the invention, various departures and modifications thereof will occur to those skilled in the art, which modifications are intended to be within the scope of my invention as defined in the apended claims.

What is claimed is:

1. A waterbed mattress construction having baffle damper means for substantially eliminating water wave action comprising:

a top sheet and a bottom sheet, said top sheet and said bottom sheet being joined to form a sealed envelope;

a plurality of baffle damper housing means in said waterbed mattress, each of said baffle damper housing means having a pair of spaced, opposed vertical sides affixed to the interior surface of said bottom sheet and having flotation means extending said baffle damper housing means vertically to contact the interior of the top sheet when weight is resting on said top sheet, said baffle damper housing means being positioned in said waterbed mattress to prevent continuous water wave action.

2. A waterbed mattress as claimed in claim 1 wherein each of said baffle damper housing means include a top portion joining said pair of sides and said floatation is affixed to said top portion.

3. A waterbed mattress as claimed in claim 2 wherein said floatation means is affixed to the interior surface of said top portion.

4. A waterbed mattress as claimed in claim 1 wherein said baffle damper housing means is an elongated inverted U-shaped housing.

5. A waterbed mattress as claimed in claim 4 wherein said floatation means is an elongated rod fixed to the interior surface of said top portion of said elongated inverted U-shaped baffle damper housing.

6. A waterbed mattress as claimed in claim 1 wherein each of said sides includes two or more apertures.

7. A waterbed mattress as claimed in claim 1 wherein said floatation means is a closed cell material.

* * * * *

UNITED STATES PATENT AND TRADEMARK OFFICE

CERTIFICATE OF CORRECTION

PATENT NO. : 4,204,289

DATED : May 27, 1980

INVENTOR(S) : Isaac Fogel

It is certified that error appears in the above-identified patent and that said Letters Patent are hereby corrected as shown below:

Column Three, line 62, change "vertical wall 18" to read "vertical wall 20"

Column Three, line 64, change "solid wall 18" to read "solid wall 20 of"

Signed and Sealed this

*Ninth* Day of *December 1980*

[SEAL]

*Attest:*

SIDNEY A. DIAMOND

*Attesting Officer*

*Commissioner of Patents and Trademarks*